US007698989B2

(12) United States Patent
Weber et al.

(10) Patent No.: US 7,698,989 B2
(45) Date of Patent: Apr. 20, 2010

(54) RECIPROCATING PISTON MACHINE

(75) Inventors: Georg Weber, Egelsbach (DE); Jan Hinrichs, Friedrichsdorf (DE)

(73) Assignee: Luk Fahrzeug-Hydraulik GmbH & Co. KG, Bad Homburg (DE)

( * ) Notice: Subject to any disclaimer, the term of this patent is extended or adjusted under 35 U.S.C. 154(b) by 0 days.

(21) Appl. No.: 10/520,212

(22) PCT Filed: Jul. 3, 2003

(86) PCT No.: PCT/DE03/02218

§ 371 (c)(1),
(2), (4) Date: Nov. 4, 2005

(87) PCT Pub. No.: WO2004/005712

PCT Pub. Date: Jan. 15, 2004

(65) Prior Publication Data

US 2006/0207423 A1 Sep. 21, 2006

(30) Foreign Application Priority Data

Jul. 4, 2002 (DE) ..... 102 30 058

(51) Int. Cl.
*F01B 3/02* (2006.01)

(52) U.S. Cl. ..... 92/71

(58) Field of Classification Search ..... 92/71
See application file for complete search history.

(56) References Cited

U.S. PATENT DOCUMENTS

| | | | |
|---|---|---|---|
| 3,552,886 A | 1/1971 | Olson, Jr. et al. | |
| 2002/0039531 A1 | 4/2002 | Morita et al. | |
| 2002/0129603 A1 * | 9/2002 | Schorr et al. | 60/592 |

FOREIGN PATENT DOCUMENTS

DE 200 13 202 U1 2/2001

* cited by examiner

*Primary Examiner*—F. Daniel Lopez
(74) *Attorney, Agent, or Firm*—Davidson, Davidson & Kappel, LLC

(57) ABSTRACT

A reciprocating piston machine, in particular a compressor, such as for the air conditioning system of an automotive vehicle. The machine includes a casing and at least one casing cover. A working unit including pistons and is arranged or formed in the casing. The intake and exhaust zone or a front shaft bearing are arranged or formed in the casing cover (covers). The casing cover is screwed on the casing. The screw assembling is carried out with the aid of ring nuts or saw tooth screw threads between the casing and the casing cover, wherein the casing and cover are made of materials with different strengths and different thermal expansion coefficients.

7 Claims, 3 Drawing Sheets

RECIPROCATING PISTON MACHINE

The present invention is directed to a reciprocating piston machine, in particular a compressor, preferably for the air conditioning system of a motor vehicle, having a housing and at least one housing cover, the power unit encompassing the pistons being accommodated or formed in the housing, and the suction and discharge areas or a forward shaft bearing being accommodated or formed in the housing cover, and the housing cover being screw-coupled to the housing.

BACKGROUND

Reciprocating piston-type machines of the type described are generally known. In this context, it may be a question of a compressor, thus, for example, of a compressor for the air conditioning system of a motor vehicle. Compressors of this kind are usually referred to as air-conditioner compressors, and include a housing, which encompasses an externally driven compressor unit or pump unit. The compressor unit designed, for example, as an axial piston machine, includes, in turn, at least one piston which is able to reciprocate in a cylinder block. It is customary for a compressor of this kind to be equipped with a plurality of pistons, which are reciprocated in the direction of their longitudinal axis in response to the rotation of a supporting plate over a swash plate or in response to the pivoting of a pivot plate or a pivot ring, in the case of a swash plate, the swash plate being mounted in a torsionally fixed manner in the housing. The housing is typically sealed by at least one housing cover which is screw-coupled to the housing, for example. In this context, the form of a ring nut that functions between the housing and the housing cover, or of a single thread or of a separate threaded ring can be used for the screw connection.

In the case of air-conditioner compressors having screwed-in, pressurized back covers, covers or cylinder heads, high axial forces are transmitted via the thread into the housing. In conjunction with the triangular threads (i.e. V-threads) typically used, these axial forces produce a radial pressure which is exerted via the thread on the housing. This radial pressure on the housing leads to relatively high peripheral stresses in the housing and increases the friction torque during the screw-in operation. Moreover, additional thermal stresses are superposed on these forces during operation and at standstill.

SUMMARY OF THE INVENTION

It is an object of the present invention to provide a compressor which will not have these disadvantages.

The present invention provides a reciprocating piston-type machine that includes a housing; a housing cover; a power unit disposed in the housing and including a plurality of pistons; one of a suction and discharge area and a forward shaft bearing disposed in the housing cover; and a screw connection configured to screw-couple the housing cover to the housing, the screw connection including sawtooth thread between the housing and the housing cover. In accordance with these features, the already realized related-art screw connection has a very particular design, namely the form of a so-called sawtooth thread.

It was discovered in accordance with the present invention that, as before, it is still possible to screw-couple the housing and the housing cover, but the problems associated with the related art methods may be minimized by using a sawtooth thread.

A reciprocating piston-type machine is preferred in which the peripheral or equivalent stresses caused by the sawtooth thread in the housing wall (and also in the cover and, respectively, the threaded ring) in the radial direction in response to axial compressive load on the cover, are substantially reduced in comparison to a triangular thread or similar threads.

In addition, a reciprocating piston-type machine is preferred, in which the tightening torque is substantially reduced by the sawtooth thread in comparison to a triangular thread or similar threads.

A reciprocating piston-type machine is also preferred, in which the thermal stresses are reduced by the sawtooth thread, i.e., the prestressing is maintained as compared to a triangular thread or similar threads.

A reciprocating piston-type machine has the distinguishing feature that the sawtooth form of the structural component having a substantially lower material strength (cylinder head of aluminum, for example) is substantially wider/larger than the sawtooth form of the structural component having a substantially higher material strength (housing of steel, for example). Here as well, a reciprocating piston-type machine is preferred, in which the length of this thread is substantially reduced as compared to the normal sawtooth thread. The result is shorter production times. A reciprocating piston-type machine is likewise preferred in which the thread has a substantially steeper pitch than does a standard sawtooth thread, without the height of the thread tooth being increased.

A reciprocating piston-type machine is also preferred in which the thread renders possible substantially less precise manufacturing tolerances does a standard sawtooth thread. A reciprocating piston-type machine is likewise preferred in which the wider sawtooth form is so wide that the thread may also be used as a surface for clamping during further machining of the particular component.

A reciprocating piston-type machine is also preferred, in which the flank angle of the sawtooth thread is <0° instead of the standard 3° according to DIN 515, when the component(s) having the external thread ("bolt") are made of a material having a greater thermal expansion (for example aluminum) than the component(s) having an internal thread ("nut", for example steel). As used herein, thermal expansion is used synonymously with thermal expansion coefficient.

In addition, a reciprocating piston-type machine is preferred, in which the flank angle of the sawtooth thread is >0° when the component(s) having the external thread are made of a material having a smaller thermal expansion than the component(s) having an internal thread.

The present invention is described below in greater detail with reference to the figures, which show:

DETAILED DESCRIPTION

Figure 1:
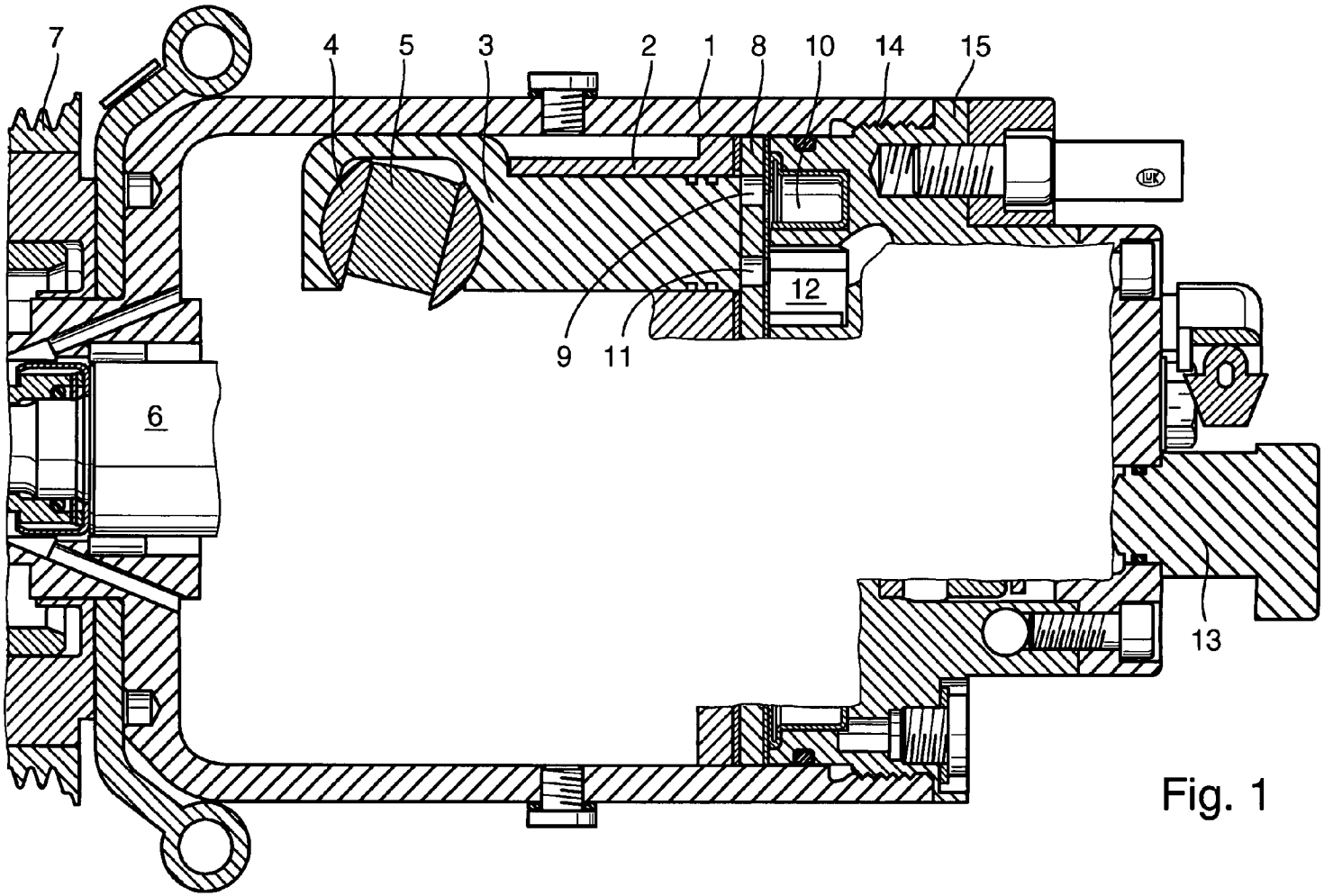
FIG. 1 an air-conditioner compressor having a thread on the cylinder head.

The housing of an air-conditioner compressor and several of its component parts are shown in cross section in FIG. 1. In a housing 1, which is preferably manufactured from steel or materials having similar strength properties, a piston and crankshaft assembly having a cylinder block 2 is accommodated, in which reciprocating pistons 3 suction and compress refrigerant, and discharge it again under pressure. Pistons 3 are coupled via piston shoes 4 to a drive device in the form of a pivot plate or a pivot ring 5. Pivot ring 5 is set into rotation by a drive shaft 6 via a driver (not shown). Pivot ring 5 may assume various pivoting angle positions and thus vary the piston displacement of the compressor. Drive shaft 6 is driven via a belt pulley device 7 in the belt drive of a combustion engine, as is customary for air-conditioner compressors used in motor vehicles.

Above cylinder block 2, a valve plate 8 having suction and discharge valves (not shown in detail here) is accommodated inside housing 1, piston 3 suctioning refrigerant out of an air-conditioning system from a suction chamber 10 via suction valves and suction orifices 9 and, following a certain rotation, compressing the refrigerant inside cylinder block 2 and delivering it via discharge orifices 11 and the discharge valves into pressure chamber 12. From there, the refrigerant is transferred, inter alia, into the air-conditioning system. By way of control valves 13, which are accommodated in the cylinder head region of the compressor, high pressure may be admitted from pressurized region 12 into the compression chamber, and the level of the compression chamber pressure may be regulated down, in turn, by admitting pressure into low-pressure region 10. The pivoting angle of the piston and crankshaft assembly and thus the piston displacement then automatically adjusts itself based on the level of the corresponding compression chamber pressure. Configured between housing 1, which, as already mentioned, in the case of $CO_2$ compressors, due to the high pressure, may preferably be manufactured from steel or similar high-strength materials, and cylinder head 15, which may be manufactured from an aluminum alloy, is a threaded connection 14. The entire cylinder head may be assembled and disassembled via this one thread. In this context, when working with the refrigerant $CO_2$, high pressures of up to 160 bar, as well as temperatures of up to 130° Celsius cause stresses to occur within the machine which, depending on the thread structure, manifest themselves as radial and axial stresses. The difference in the thermal expansion of the housing materials such as steel or the like, and of the cylinder head materials, such as aluminum, may pose an additional problem.

Figure 2:
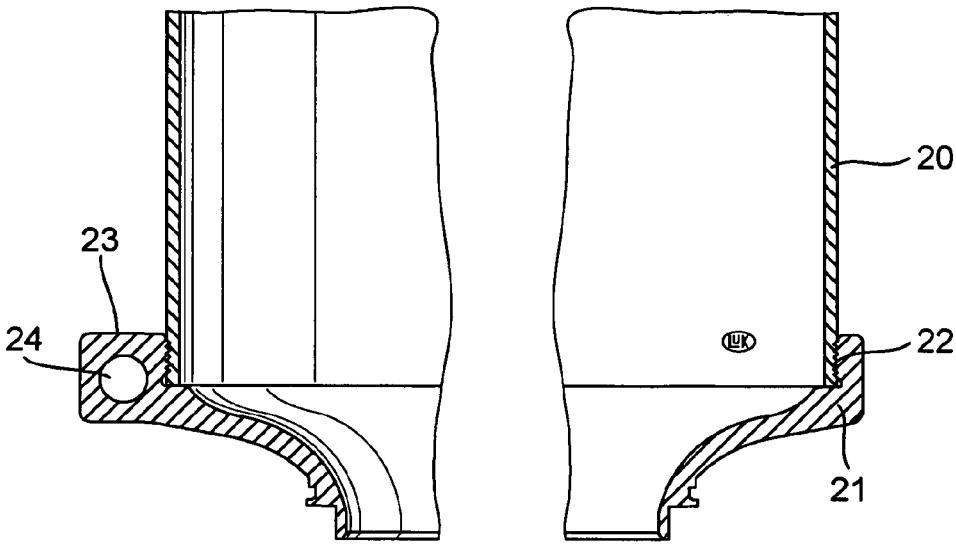
FIG. 2 the front section of a compressor having a thread on the front cover.

FIG. 2 illustrates the housing part of another compressor, in which the front housing part is also sealed by a cover. The substantially tubular housing 20 made of steel or similar materials is screw-coupled via a thread 22 to front housing cover 21. A shaft bearing (not shown here), as well as a shaft sealing device may be accommodated in the area of the front housing cover. Front housing cover may likewise be made of a steel material or also of an aluminum alloy. At some locations, the front housing cover includes fastening devices in the form of fixing eyelets 23, which, via cutouts 24, enable the compressor to be secured to corresponding mounts of the automotive engine. This thread 22 in the front area of the compressor is also subjected to corresponding stresses due to compression chamber pressures and temperature loading, even if they are not as high as on the cylinder head side, where, for example, in FIG. 1, in pressurized region 12, the high pressure acts on cylinder head 15 and attempts to press it away toward the outside.

Figure 3:
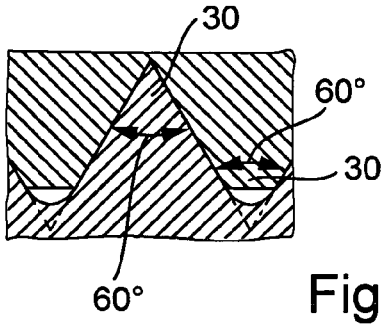
FIG. 3 the representation of a triangular thread.

A normal triangular thread, which is mainly provided for these kinds of fastenings, is illustrated in FIG. 3. In accordance with thread angle 30 of approximately 60°, due to axially acting pressures on the cylinder head, for example, the axial forces are applied via the angles of the thread into the housing and produce axial and radial stresses there.

Figure 4:
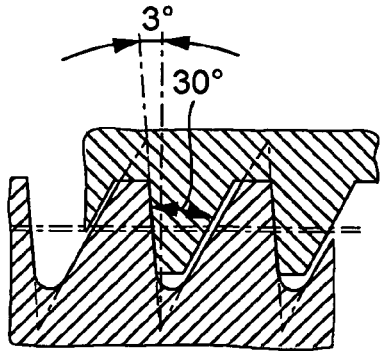
FIG. 4 the representation of a sawtooth thread.

FIG. 4 depicts a sawtooth thread which is principally used by experts in the field for transmitting forces through screw drive mechanisms in only one axial direction, for example in impact screw presses. In accordance with the present invention, this sawtooth thread is also particularly advantageous for fastening the compressor parts described above. By using a sawtooth thread of this kind, it is possible to reduce both the thread engagement torque during assembly, as well as the radial pressure acting on the housing during operation of the compressor and thus the equivalent stresses in the thread region of the housing. Due to the reduction in loading on the housing and in the tightening torque, given the same outlay for manufacturing, smaller wall thicknesses in the housing and shorter threads are possible. Associated with this is a weight reduction, as well.

Figure 5:
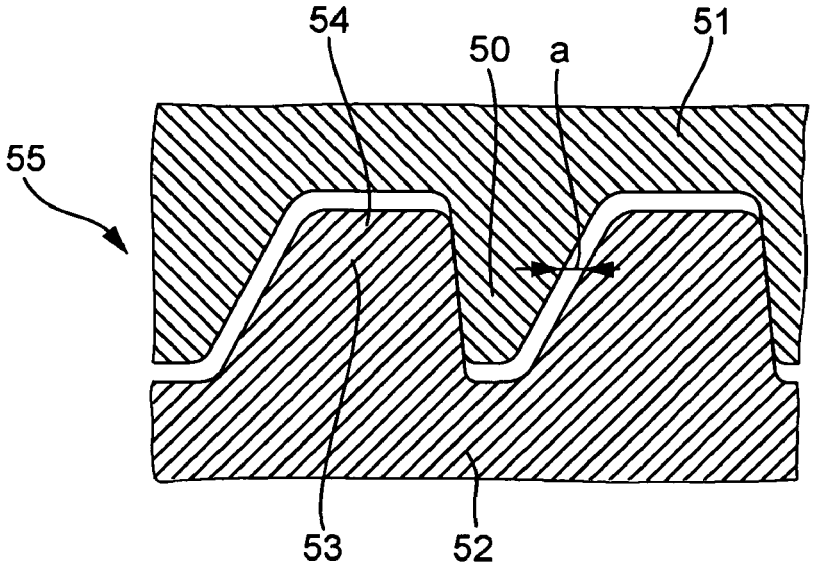
FIG. 5 the representation of a special sawtooth thread having a broad and narrow toothing.

Another design according to the present invention of a sawtooth thread for air-conditioner compressor applications is illustrated in FIG. 5.

In FIG. 5, the sawtooth thread in question of housing 51, which is made of the previously described steel material, is provided with suitably narrow thread teeth 50, while cylinder head 52 made of an aluminum alloy is provided with wide thread teeth 53 suitably designed in accordance with the low strength of the aluminum material. This means that, in order to better utilize the materials in the housing thread, a standard sawtooth thread is appropriately modified in accordance with the present invention. This modification leads to a steeper thread pitch and to a reduced thread length, thereby resulting in shorter thread fabrication times. Also, less precise tolerances are possible, such as those at clearance (a), for example. Another advantage may also be derived in that, due to large tooth width 54, the external thread of the cylinder head may be utilized for clamping purposes in the further machining of the cylinder head. The sawtooth thread is aligned in such a way that, for example, the compression chamber pressure, a well as the high pressure within the cylinder head act from direction 55 on the cylinder head and thereby press the perpendicular flanks of the cylinder head thread and of the housing thread against each other. As a result, the axial compressive forces are also principally transmitted in the axial direction, and the radial components are minimal in comparison to a triangular thread, as illustrated in FIG. 3.

Figure 6:
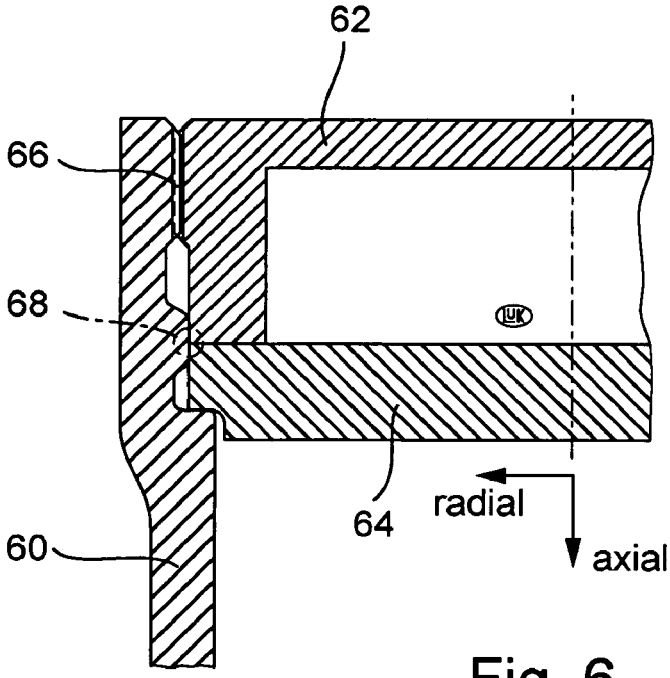
FIG. 6 the representation of components having different thermal expansion.

FIG. 6 depicts components of materials having different thermal expansion. Component 60 represents the housing, for example, while component 64, for example, a part of the cylinder block, and component 62 may represent the cylinder head or the housing cover of the compressor. Component 62 and component 60 are interconnected by a sawtooth thread 66 in accordance with the present invention, while a centering of components 64 and 62 within component 60 is shown in region 68. If, at this point, components 62 and 64 have a greater thermal expansion than component 60, then a sawtooth thread having a flank angle of <0° is selected instead of the flank angle of 3° in accordance with DIN 515. Then, in the case of a heating or cooling, and given available expansion space in the thread root for the engaging thread tooth, there is no change in the prestressing when the direction of the thread flank runs in parallel to the occurring thermal expansions in the axial and radial direction of component 64 and of component 62 minus the thermal expansions of component 60.

When components 62 and 64 have a smaller thermal expansion than component 60, then a sawtooth thread having a flank angle of >0° is selected. Then, in the case of a heating or cooling, and given available expansion space in the thread root for the engaging thread tooth, there is no change in the prestressing when the direction of the thread flank runs in parallel to the occurring thermal expansions in the axial and radial direction of component 64 and of component 62 minus the thermal expansions of component 60.

Thus, in accordance with the present invention, the standard flank angle of the sawtooth thread of 3° according to DIN 515 is selectively reduced as a function of the thermal expansion of the materials used and of the geometry of the components. This has the advantage that the thermal stresses in the thread region are able to be further reduced and, respectively, the prestressing in the thread region is able to be maintained. Further advantages are derived in that there is less loading on the housing, given the same outlay for manufacturing. As a result, smaller wall thicknesses in the housing and shorter threads are possible. Associated with this is a weight reduction, as well.

The claims filed with the application are proposed formulations and do not prejudice the attainment of further patent protection. The applicant reserves the right to claim still other combinations of features that, so far, have only been disclosed in the specification and/or the drawings.

The antecedents used in the dependent claims refer, by the features of the respective dependent claim, to a further embodiment of the subject matter of the main claim; they are not to be understood as renouncing attainment of an independent protection of subject matter for the combinations of features of the dependent claims having the main claim as antecedent reference.

Since, in view of the related art on the priority date, the subject matters of the dependent claims may form separate and independent inventions, the applicant reserves the right to make them the subject matter of independent claims or of divisional applications. In addition, they may also include independent inventions, whose creation is independent of the subject matters of the preceding dependent claims.

The exemplary embodiments are not to be understood as limiting the scope of the invention. Rather, within the framework of the present disclosure, numerous revisions and modifications are possible, in particular such variants, elements and combinations and/or materials, which, for example, by combining or altering individual features or elements or method steps described in connection with the general description and specific embodiments, as well as the claims, and contained in the drawings, may be inferred by one skilled in the art with regard to achieving the objective, and lead, through combinable features, to a new subject matter or to new method steps or sequences of method steps, also to the extent that they relate to manufacturing, testing, and operating methods.

What is claimed is:

1. A reciprocating piston-type machine, comprising:

a housing;

a housing cover;

a power unit disposed in the housing and including a plurality of pistons;

one of a suction and discharge area and a forward shaft bearing disposed in the housing cover; and a screw connection configured to screw-couple the housing cover to the housing, the screw connection including sawtooth thread between the housing and the housing cover;

wherein the screw connection includes first thread side including a first material having a first material strength and a second thread side including a second material having a second material strength higher than the first material strength, wherein each tooth of the first thread side is larger than a corresponding tooth of the second thread side.

2. The reciprocating piston-type machine as recited in claim 1, wherein a length of the sawtooth thread in an axial direction is less than a standard sawtooth thread.

3. The reciprocating piston-type machine as recited in claim 1, wherein a pitch of the saw tooth thread is steeper pitch than a standard sawtooth thread.

4. The reciprocating piston-type machine as recited in claim 1, wherein a manufacturing tolerance of the saw tooth thread is larger than a standard manufacturing tolerance of a standard sawtooth thread.

5. The reciprocating piston-type machine as recited in claim 1, wherein the first thread side is disposed on one of the housing and the housing cover, and wherein each tooth of the first thread side includes an upper surface that is sufficiently wide for clamping during further machining of the housing or housing cover.

6. A reciprocating piston-type machine, comprising:

a housing;

a housing cover;

a power unit disposed in the housing and including a plurality of pistons;

one of a suction and discharge area and a forward shaft bearing disposed in the housing cover; and a screw connection configured to screw-couple the housing cover to the housing, the screw connection including sawtooth thread between the housing and the housing cover;

wherein the screw connection includes an external thread side including a material having a first thermal expansion coefficient and an internal thread side including a material having a second thermal expansion coefficient less than the first thermal expansion coefficient, and wherein a flank angle of the sawtooth thread is <0°.

7. A reciprocating piston-type machine, comprising:

a housing;

a housing cover;

a power unit disposed in the housing and including a plurality of pistons;

one of a suction and discharge area and a forward shaft bearing disposed in the housing cover; and a screw connection configured to screw-couple the housing cover to the housing, the screw connection including sawtooth thread between the housing and the housing cover;

wherein the screw connection includes an external thread side including a material having a first thermal expansion coefficient and an internal thread side including a material having a second thermal expansion coefficient greater than the first thermal expansion coefficient, and wherein a flank angle of the sawtooth thread is >3°.

* * * * *